US008243945B2

(12) United States Patent
Li

(10) Patent No.: US 8,243,945 B2
(45) Date of Patent: Aug. 14, 2012

(54) EARPHONE JACK

(75) Inventor: Chih-Hao Li, Taipei County (TW)

(73) Assignee: Chi Mei Communication Systems, Inc., Tu-Cheng, New Taipei (TW)

( * ) Notice: Subject to any disclaimer, the term of this patent is extended or adjusted under 35 U.S.C. 154(b) by 819 days.

(21) Appl. No.: 12/330,605

(22) Filed: Dec. 9, 2008

(65) Prior Publication Data

US 2010/0014701 A1 Jan. 21, 2010

(30) Foreign Application Priority Data

Jul. 15, 2008 (CN) ..... 2008 1 0302749

(51) Int. Cl.
*H04R 25/00* (2006.01)

(52) U.S. Cl. ..... 381/74; 381/370; 381/384; 381/309; 439/775

(58) Field of Classification Search ..... 381/74, 381/370, 374, 384, 309; 439/77, 660, 775
See application file for complete search history.

(56) References Cited

U.S. PATENT DOCUMENTS

| | | | | |
|---|---|---|---|---|
| 7,248,707 | B2 * | 7/2007 | Peng et al. | 381/74 |
| 7,836,216 | B2 * | 11/2010 | Kashi et al. | 710/15 |
| 2008/0175402 | A1 * | 7/2008 | Abe et al. | 381/71.6 |
| 2008/0175420 | A1 * | 7/2008 | Chung et al. | 381/309 |

* cited by examiner

*Primary Examiner* — Tom Thomas
*Assistant Examiner* — Benjamin Tzu-Hung Liu
(74) *Attorney, Agent, or Firm* — Altis Law Group, Inc.

(57) ABSTRACT

An earphone jack (100) for a portable electronic device includes a detecting module (20) and a jack module (30). The detecting module is configured for detecting if a plug of an earphone has been connected to the earphone jack. The jack module is connected to the detecting module, and includes a connecting hole (32) configured for receiving the plug defined therein, two earphone connectors (333, 334) configured for connecting the plug, a contacting member (35) connected to the detecting module, and a movable member (331) separately connected to the contacting member. Therefore, the detecting module can detect the plug connected to the earphone jack without causing any instantaneous current in the jack module and the plug.

2 Claims, 2 Drawing Sheets

EARPHONE JACK

BACKGROUND OF THE INVENTION

1. Technical Field of the Invention

The present invention generally relates to earphone jacks, particularly to an earphone jack preventing damage from instantaneous currents.

2. Description of related art

Nowadays, many portable electronic devices such as mobile phones or CD players, have earphone jacks configured for connecting with an earphone to play audio signals. Generally, an earphone is connected to a jack of a portable electronic device through a plug. The portable electronic device detects the plug, and electronic signals, such as speech or music, provided by the portable electronic device can be converted into audio signals by the earphone.

However, when using most conventional earphone jacks, portable electronic devices detect earphones connected thereto by sending electrical detection signals to the jack and, subsequently, receiving electrical response signals from the jack. When an earphone is connected to a jack, the electrical signals for detecting the earphone may cause an instantaneous current passing through the jack and the earphone. The instantaneous current may cause cacophony, which impairs the quality of the audio signals converted by the earphone. Furthermore, the instantaneous current may damage circuits of the earphone and the jack.

Therefore, there is room for improvement within the art.

BRIEF DESCRIPTION OF THE DRAWINGS

Many aspects of the new earphone jack can be better understood with references to the following drawings. The components in the drawings are not necessarily drawn to scale, the emphasis instead being placed upon clearly illustrating the principles of the new earphone jack. Moreover, in the drawings, like reference numerals designate corresponding parts throughout the several views.

DETAILED DESCRIPTION OF THE EMBODIMENTS

Figure 1:
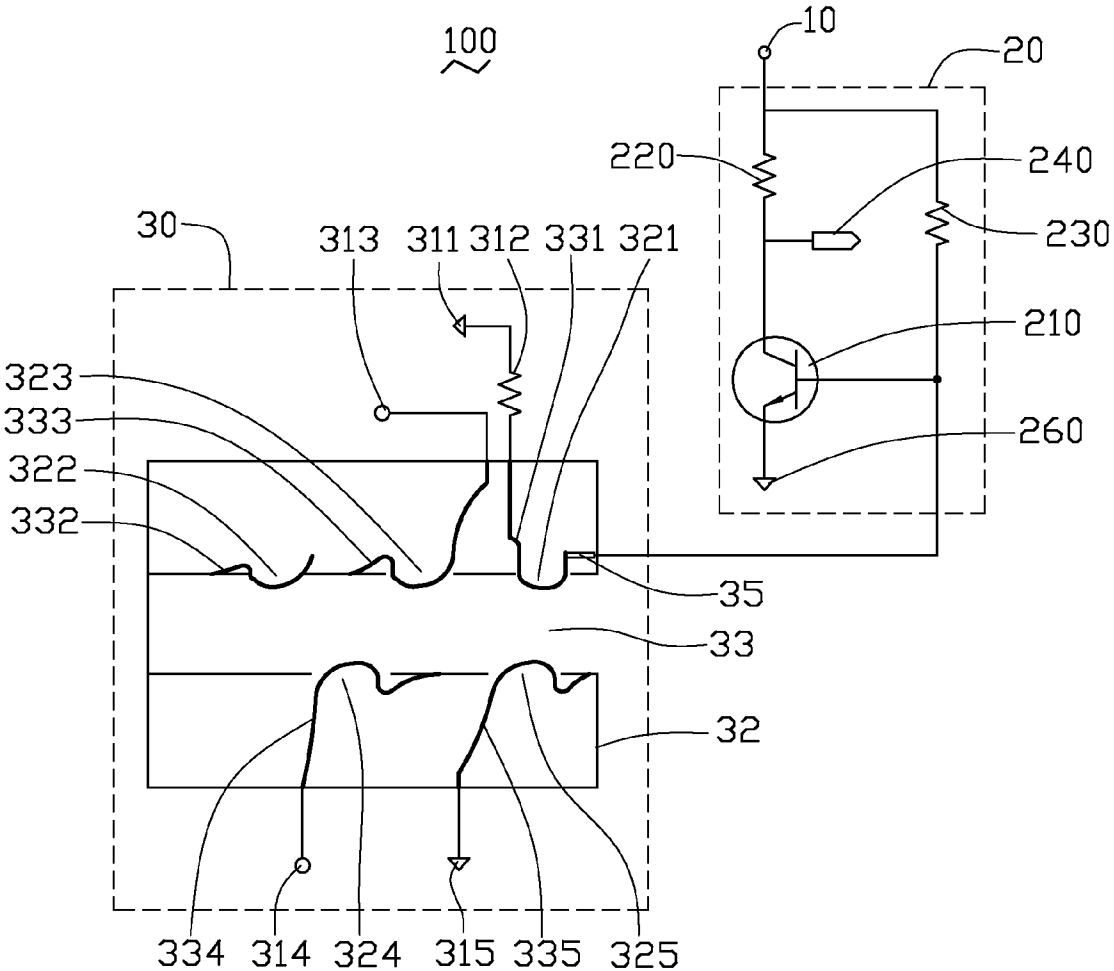
FIG. 1 is a block, schematic, circuit diagram of an earphone jack, according to an exemplary embodiment.

FIG. 1 shows an earphone jack 100 according to an exemplary embodiment. The earphone jack 100 can be installed in a portable electronic device, such as a mobile phone or a CD player, to convert electrical signals provided thereby into audio signals. The earphone jack 100 includes a power supply connector 10, a detecting module 20 and a jack module 30. The power supply connector 10 is used to connect to a power supply (not shown), which provides electrical power to the earphone jack 100. The detecting module 20 is connected to the power supply connector 10. The jack module 30 is connected to the detecting module 20 when an earphone is not connected to the jack module 30.

The detecting module 20 includes a transistor 210, a first resistor 220, a second resistor 230, a detecting connector 240 and a first ground 260. The first resistor 220 has one end connected to the power supply connector 10 and another end connected to a collector of the transistor 210. The second resistor 230 has one end connected to the power supply connector 10 and another end connected to a base of the transistor 210. The detecting connector 240 has one end connected between the first resistor 220 and the collector of the transistor 210, and another end connected to a circuit (not shown) of the portable electronic device for detecting earphones connected to the jack module 30. An emitter of the transistor 210 is connected to the first ground 260.

The jack module 30 includes a case 32 configured for being installed in portable electronic devices, a connecting hole 33 defined in the case 32 and configured for receiving an earphone plug, a contacting member 35 mounted on the case 32, and five receiving apertures 321, 322, 323, 324 and 325 defined in the case 32. The receiving apertures 321-325 all communicate with the receiving hole 33. The contacting member 35 is connected to the power supply 10 through the second resistor 230, and the base of the transistor 210 is connected between the second resistor 230 and the contacting member 35.

The jack module 30 further includes a second ground 311, a third resistor 312, a first circuit connector 313, a second circuit connector 314, a third ground 315, a movable member 331, a retaining member 332, a left earphone connector 333, a right earphone connector 334 and a grounding connector 335. The movable member 331, the retaining member 332, the left circuit connector 333, the right earphone connector 334 and the grounding connector 335 are all made of elastic conductive materials, such as metal, and are all received in the case 32.

The movable member 331 is received in a first receiving aperture 321 and connected in series to the third resistor 312. The third resistor 312 is connected in series to the second ground 311. The retaining member 332 is received in a second receiving aperture 322. The left earphone connector 333 is received in a third receiving aperture 323 and connected to the first circuit connector 313. The right earphone connector 334 is received in a fourth assembling aperture 324 and connected to the second circuit connector 314. The first circuit connector 313 and the second circuit connector 314 are connected to inner circuits of the portable electronic device. Thus, the portable electronic device can provide electrical signals to the jack module 30 through the first circuit connector 313 and/or the second circuit connector 314. The grounding connector 335 is received in a fifth receiving aperture 325 and is connected to the third ground 315. The movable member 331, the retaining member 332, the left earphone connector 333, the right earphone connector 334 and the grounding connector 335 are all exposed from their corresponding receiving apertures, and all extend into the connecting hole 33.

In assembly, the earphone jack 100 is installed in a portable electronic device, such as a mobile phone or a CD player. The power supply connector 10 is connected to a power source to obtain electrical power. The contacting member 35 is positioned to be in contact with the movable member 31, thereby electrically connecting the detecting module 20 to the jack module 30. The connecting hole 33 is exposed from the portable electronic device. The detecting connector 240 is connected to a circuit of the portable electronic device for detecting earphones connected to the jack module 30.

As seen in FIG. 1, when earphones have not been inserted into the connecting hole 33, the contacting member 35 remains in contact with the movable member 31. Thus, the power supply connector 10, the second resistor 230, the third resistor 312 and the second ground 311 are connected in series. Therefore, an electrical potential U1 located on the base of the transistor 210 is reduced by the third resistor 312. By regulating the resistance of the second resistor 230 and the third resistor 312, the electrical potential U1 is regulated to be less than a turn-on voltage of the transistor 210. Thus, the transistor 210 is turned off, and the detecting connector 240 connected to the collector of the transistor 210 outputs a high electrical potential. The high electrical potential can be received by the portable electronic device. If the portable electronic device detects that no plugs have been connected to the jack module 30, it does not send signals to the jack module 30.

Figure 2:
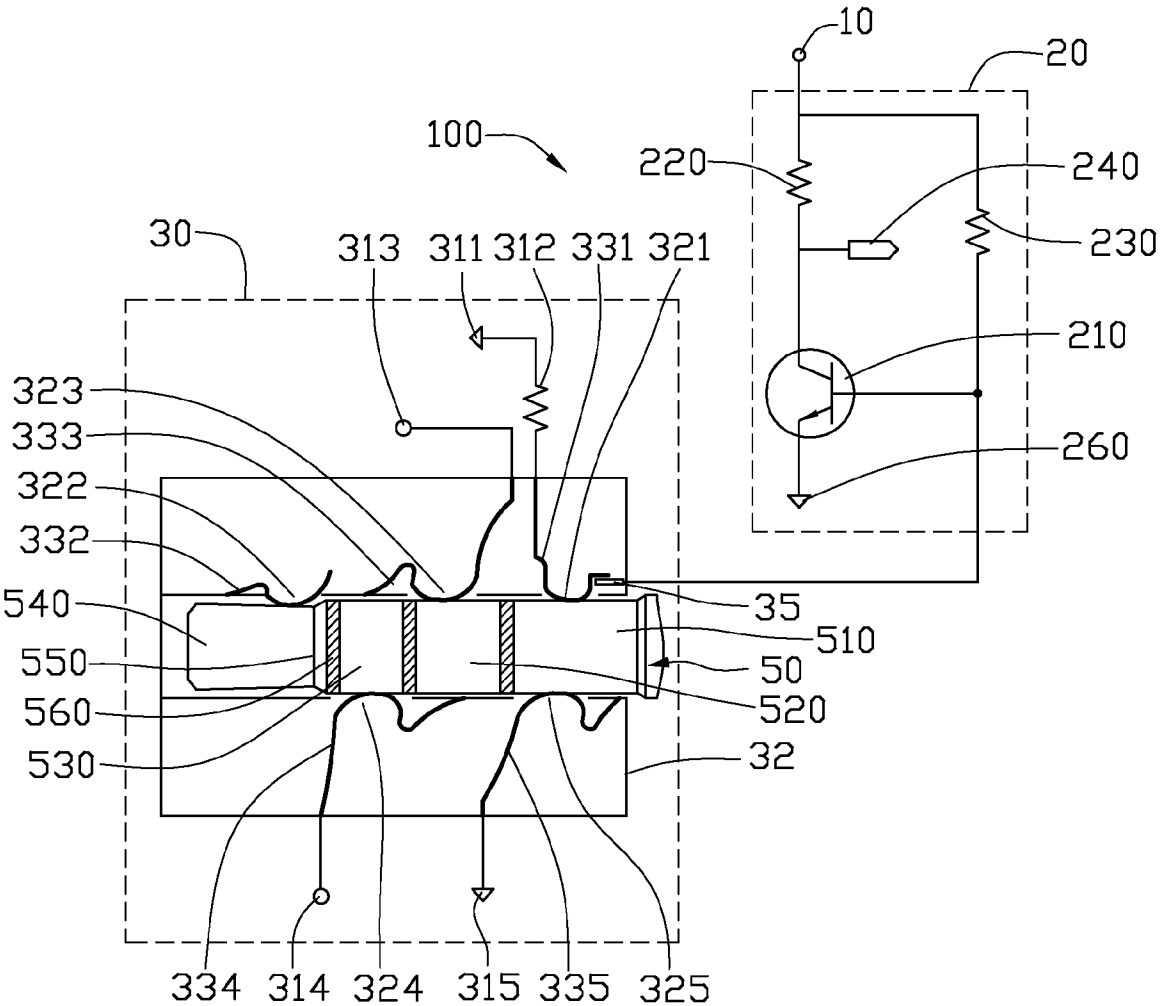
FIG. 2 is a schematic view of connecting an earphone to the earphone jack shown in FIG. 1.

Referring to FIG. 2, a plug 50 of an earphone (not shown) is connected to the jack module 30. The plug 50 has a substantially cylindrical shape corresponding to the shape of the connecting hole 33. The plug 50 includes four connecting portions 510, 520, 530, 540, and a plurality of annular insulated portions 560 configured for separating the connecting portions 510, 520, 530, 540. A first connecting portion 510 is formed on a base of the plug 50 and is configured for grounding. A second connecting portion 520 is formed adjacent to the first connecting portion 510 and a third connecting portion 530 is formed adjacent to the second connecting portion 520. The second and third connecting portions 520, 530 are configured for connecting to the left and right speakers of the earphone, respectively. A fourth connecting portion 540 is formed on an end of the plug 50 adjacent to the third connecting portion 530. A diameter of the fourth connecting portion 540 is less than the diameter of the third connecting portion 530, and an inclined surface 550 is formed between the third connecting portion 530 and the fourth connecting portion 540.

In use, the plug 50 is inserted into the connecting hole 33. The first connecting portion 510 contacts with the grounding connector 335 to connect to the ground. The second connecting portion 520 and the third connecting portion 530 are respectively connected to the left earphone connector 333 and the right earphone connector 334 to obtain electrical signals. The first connecting portion 510 resists the movable member 331 to separate from the contacting member 35. The retaining member 332 contacts the fourth connecting portion, and resists the inclined surface 550 to retain the plug 50 in the connecting hole 33.

When the movable member 331 is separated from the contacting member 35 by the plug 50, the power supply connector 10, the transistor 210, the first resistor 220, the second resistor 230 and the first ground 260 are connected in series. An electrical potential of the power source, which is higher than the turn-on voltage of the transistor 210, is input into the base of the transistor 210. Thus, the transistor 210 is turned on, and the detecting connector 240 outputs a low electrical potential. The low electrical potential is received by the portable electronic device. If the portable electronic device detects that the plug 50 is connected to the jack module 30, it sends signals to the earphone through the jack module 30.

Understandably, when the plug 50 is connected to the jack module 30, the movable member 331 is separated from the contacting member 35. The detecting module 20 is insulated with the jack module 30 and the plug 50, and electrical signals for detecting the plug 50 pass through the detecting module 20, but not the jack module 30 and the plug 50. As such, no instantaneous current will be formed in the jack module 30 and the plug 50. Therefore, the jack module 30 and the plug 50 are protected from instantaneous current, and an audio quality of the earphone is improved.

It is believed that the present embodiments and their advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

What is claimed is:

1. An earphone jack for connecting an earphone plug, comprising:

a jack module, the jack module including a connecting hole for receiving the earphone plug, a contacting member, and a grounded movable member; and a detecting module connected to the contacting member; wherein when the earphone plug is not received in the connecting hole, the contacting member is connected to the movable member to be grounded, and the detecting module correspondingly outputs a first electric potential for indicating that the earphone plug is not connected to the earphone jack; and when the earphone plug is received in the connecting hole, the movable member is resisted by the earphone plug and separated from the contacting member, and the detecting module correspondingly outputs a second electric potential for indicating that the earphone plug is connected to the earphone jack;

wherein the detecting module includes a transistor and a detecting connector, the transistor including a base, an emitter, and a collector, the base connected to the contacting member, the emitter grounded, and the collector connected to the detecting connector; the first and second electric potentials output from the detecting connector;

wherein the earphone jack further comprises a power supply connector for connecting a power supply; the power supply connector connected to the base, the collector, and the contacting member; wherein when the contacting member is connected to the movable member to be grounded, the power supply is grounded through the power supply connector, the movable member and the contacting member, such that the transistor is turned off and the first electric potential is correspondingly generated and output from the detecting connector; and when the contacting member is separated from the movable member, the power supply provides an electric potential to the base to turn on the transistor, such that the second electric potential is correspondingly generated and output from the detecting connector; and wherein the detecting module further includes two resistors, one of the two resistors is connected between the power supply connector and the collector, and the other of the two resistors has one end connected to the power supply connector and another end connected to the base and the contacting member.

2. The earphone jack as claimed in claim 1, wherein the jack module further includes a resistor, and the movable member is grounded through the resistor.

* * * * *